US006775927B2

(12) United States Patent
Glicksman

(10) Patent No.: US 6,775,927 B2
(45) Date of Patent: Aug. 17, 2004

(54) REMOVABLE HEEL CUSHION

(76) Inventor: Milton Glicksman, 501 Sunderland Rd., Teaneck, NJ (US) 07666

( * ) Notice: Subject to any disclaimer, the term of this patent is extended or adjusted under 35 U.S.C. 154(b) by 43 days.

(21) Appl. No.: 10/244,437

(22) Filed: Sep. 16, 2002

(65) Prior Publication Data

US 2004/0049943 A1 Mar. 18, 2004

(51) Int. Cl.[7] ..... A43B 21/36; A43B 3/10

(52) U.S. Cl. ..... 36/36 R; 36/7.8; 36/42; 36/37; 36/72 B

(58) Field of Search ..... 36/7.1 R, 7.5, 36/7.8, 36 R, 38, 42, 37, 27, 72 B, 135, 7.1 A

(56) References Cited

U.S. PATENT DOCUMENTS 553,128 A * 1/1896 McDonald ..... 36/38
832,987 A * 10/1906 Linwood ..... 36/7.5
1,272,490 A * 7/1918 Matear ..... 36/37
1,869,988 A * 8/1932 Vellner ..... 36/72 B
2,033,313 A * 3/1936 Wilson ..... 36/7.5
2,142,981 A * 1/1939 Richards ..... 36/7.3
2,287,744 A * 6/1942 Monahan ..... 361/223
2,444,865 A * 7/1948 Warrington ..... 36/38
3,821,858 A * 7/1974 Haselden ..... 36/135
3,913,243 A * 10/1975 Arnold et al. ..... 36/135
4,246,707 A * 1/1981 Pedersen ..... 36/100
4,942,677 A * 7/1990 Flemming et al. ..... 36/27

* cited by examiner

*Primary Examiner*—M. D. Patterson
(74) *Attorney, Agent, or Firm*—Martin Parkinson

(57) ABSTRACT

A removable heel cushion is described. The cushion is comprised of a heel pocket and a resilient shock absorber configured for placement within the heel pocket. The assembled removable heel cushion is easily connected to a shoe by placing the heel pocket over the heel section of a shoe, whether the shoe is flat soled or has a heel, and then securing attachments, such as shoe laces or VELCRO™ tipped straps, over the upper section of the shoe. Resilient shock absorbers can vary from coiled springs to vacuum formed hemispheres customized to user preference. Shock absorbers can be frangibly attached to the heel pocket for replacement or additions according to user preferences.

20 Claims, 4 Drawing Sheets

REMOVABLE HEEL CUSHION

This invention relates to devices and methods for cushioning feet during normal walking, and in particular to a removable heel cushion.

BACKGROUND

Pain and discomfort are often experienced by many individuals during normal walking. This is especially true for people with various forms of arthritis affecting the knee and ankle. Conditions causing involvement of the foot, such as plantar fascitis, obviously require direct attention to provide a degree of comfort while walking.

Many devices and methods have, of course, been suggested in the past to relieve heel pressure while walking or running, especially in the field of athletic foot wear. For example, U.S. Pat. No. 5,435,079, issued Jul. 25, 1995, teaches the use of a spring 26 (FIG. 1) fixably attached to a heel portion of a sole 12 (FIG. 1) in order to provide shock absorbence and energy return while walking or running with an athletic shoe. As depicted in FIG. 4 the sole 12 is shown detachably fixable to shoe 10. Additional embodiments include removable hollow heel members 50 shown in FIGS. 6 and 7. Again, in U.S. Pat. No. 6,405,455 B1, issued Jun. 18, 2002, teaches a shock-absorbing running shoe 10 (FIG. 1). In this shoe 10 the heel portion of the foot is suspended by means of elastic bands 48, 38 (FIG. 2) connected to adjustable struts 24, 44 (FIG. 2) over a hollow portion 18 within the heel portion of the shoe 10, thereby providing for a larger clearing area under the heel portion of the foot, and thus a greater range of shock absorption. Additionally to the above noted U.S. patents, U.S. Pat. No. 5,826,352, issued Oct. 27, 1998, teaches the use of a rotatable and replaceable rear sole 28 (FIG. 2) to provide longer wear. Provisions are provided for rotating, removing, or inverting the rear sole 28 as may be required.

While the above noted devices and methods provide useful concepts for problems associated with shocks to the heel portion of the foot encountered during normal walking, they do not envision the simplicity and economy inherent in the present invention.

It is therefore a primary object of the invention to provide removable heel cushions for resilient shock absorption during normal walking.

An additional object of the invention is to provide for a quick installation and quick release of a pair of removable heel cushions depending on user requirements.

An additional object of the invention is to provide removable heel cushions with user determined degrees of resilient shock absorption.

A further object of the invention is to provide economical removable heel cushions.

SUMMARY

These and other objects are obtained with the removable heel cushion of the present invention.

The large number and variety of shoes and shoe inserts routinely recommended for relieving pain and discomfort in the foot and leg during normal walking clearly indicate room for improvement and simplification. In the case of the special shoe, high cost is likely a factor. In addition, the user is generally "locked into" wearing the shoes for an extended period of time. And in the case of shoe inserts they often tend to create problems in and of themselves. And again the user is generally committed to using the inserts for extended periods of time.

It occurred that it would be desirable to have a method for converting comfortable, everyday shoes into efficient, resilient shock absorbers at the users convenience. To this end a heel pocket, generally resembling the shape of a traditional heel portion of a shoe, has been formed. The heel pocket can be made of a variety of materials, including cloth, leather, or plastics. The tough, elastomeric qualities of polyurethane plastic make this material particularly suitable for this application. The heel pocket has a solid floor bordered by a narrow width front retaining wall for securing the shock absorber to be placed within the pocket, and upstanding generally linear and parallel to each other left and right side walls confluent with an upstanding arcuate shaped rear wall. Left and right side fastening strips are attached to the left and right upstanding side walls. The fastening strips can be attached to the heel pocket side walls in any convenient manner, such as, for example, gluing, sewing, heat sealing, and so on. One type of fastener can be a pair of heat sealed strips of polyurethane with a portion of each end of the strips having an attached oppositely positioned hook and loop area such as VELCRO™ to enable fast and easy installation and removal of the removable heel cushion as required. A second type of fastening strip can be a pair of shoe laces, secured via a knot on one side of a pair of holes in the upstanding left and right side walls of the heel pocket, again providing for fast and easy attachment and removal of the removable heel cushion. Obviously many other convenient closures can be used, as, for example, snaps and buckles, according to designer preference.

The above described heel pocket provides a convenient receptacle for the placement of any one of a variety of resilient shock absorbers. The shock absorbers can, of course, be permanently installed, but are preferably supplied installed in a manner permitting customer removal and replacement as required by customer preferences. For example, coil springs fabricated in metal, plastic, or rubber, can be placed within the heel pocket. A range of shock absorbing spring specifications can be made available for user selection. A preferred shock absorber would be a thick sheet of polyurethane plastic having a series of hemispheres vacuum formed within the sheet. The sheet is configured to fit within the heel pocket of the removable heel cushion of the invention, being positionally secured within the heel cushion with a frangible adhesive patch affixed to a base portion of the sheet. In use the weight of the body would flatten out and compress the hemispheres. Since the polyurethane is an elastomeric material the hemispheres will spring back as the body moves forward. Again, in this case, resilient shock absorbing can be made to user preference by varying the thickness of the polyurethane sheet.

To use the removable heel cushion of the invention a user simply places the heel section of his or her shoe into the heel pocket of the assembled removable heel cushion and secures the straps or laces over the upper portion of the foot adjacent the ankle or of the shoe. In the case of a shoe having only a sole and no heel, the upstanding side walls and upstanding rear wall fit over the rear or heel area of the upper portion of the shoe with the outer surface of the shock absorber within the heel pocket contacting the outer surface of the rear portion of the sole. And in the case of a shoe with a heel the upstanding side walls, upstanding rear wall, and front panel of the heel pocket fit over the outer side surfaces of the heel, with the shock absorber within the heel pocket now contacting the base or floor contacting surface of the heel of the shoe. The fastening strips attached to the sides of the heel pocket are now simply secured over the top of the foot or shoe of the user, either on a top portion of the users foot just ahead of the ankle, or on a top surface of a shoe, depending on the style of the shoe.

Thus it can be seen that the combination heel pocket, shock absorber, and fastening strips comprise a unique, new, removable heel cushion. Users can quickly and easily connect or disconnect these cushions on a wide variety of every day shoes to obtain a cushioned gait while walking at just about any time considered desirable. And user selected shock absorbers can customize the removable heel cushion to user requirements

DETAILED DESCRIPTION

Figure 1:
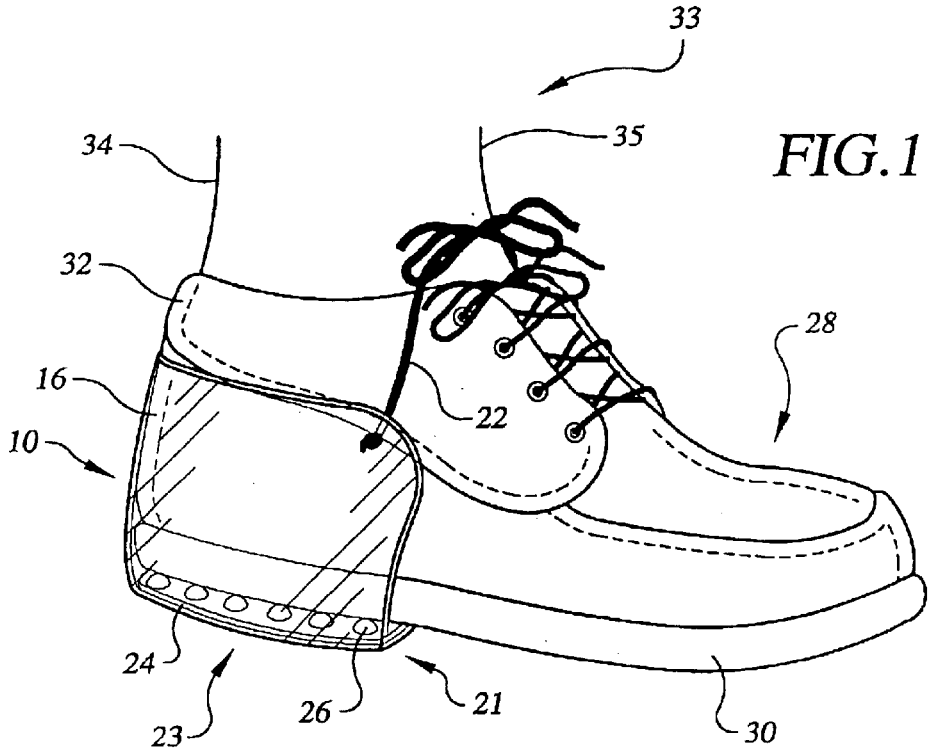
FIG. 1 is a perspective view of one version of the invention, showing the removable heel cushion in place on a generally flat soled shoe, connected to the shoe and foot of a user secured within the shoe by means of a shoe lace fastener.

Turning now to the drawings wherein similar structures having the same function are denoted with the same numerals, in FIG. 1 a perspective view of one version of the invention of a removable heel cushion 10 is shown. A user 33 is wearing a shoe 28 having a generally flat sole 30, with the removable heel cushion 10 attached at a rear portion of the shoe 28. In this case the heel pocket 21 (FIG. 3) of the removable heel cushion 10 contains a formed polyurethane sheet shock absorber 23, the assembled removable heel cushion being attached to the upper portion 35 of a users foot adjacent the ankle 34 of said user by means of a pair of shoe laces 22 attached to the removable heel cushion.

Figure 2:
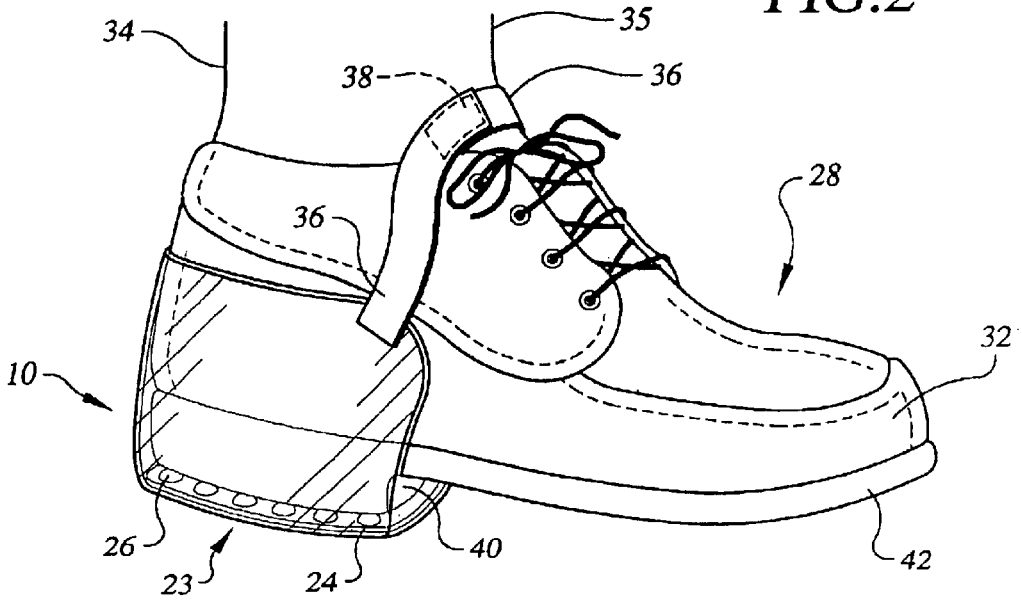
FIG. 2 is a perspective view of one version of the invention, showing the removable heel cushion in place on a typical heel portion of a shoe sole, connected to the shoe and foot of a user secured within the shoe by means of a hook and loop fastener.

In a view similar to FIG. 1 described above, in FIG. 2 the removable heel cushion 10 is shown attached to a shoe 28 having a sole with a generally flat forward portion 42 and a rear heel 40 extending downward generally perpendicular to the forward portion 42. In this case the cushion 10 is again shown with a formed polyurethane sheet shock absorber 23 secured in the heel pocket 21 of the cushion 10, with the assembled cushion 10 secured to the upper portion 35 of a users foot adjacent the ankle 34 of said user with a pair of polyurethane straps 36 fastened to one another by an attached section of a hook and loop fastener 38 such as VELCRO™.

Figure 3:
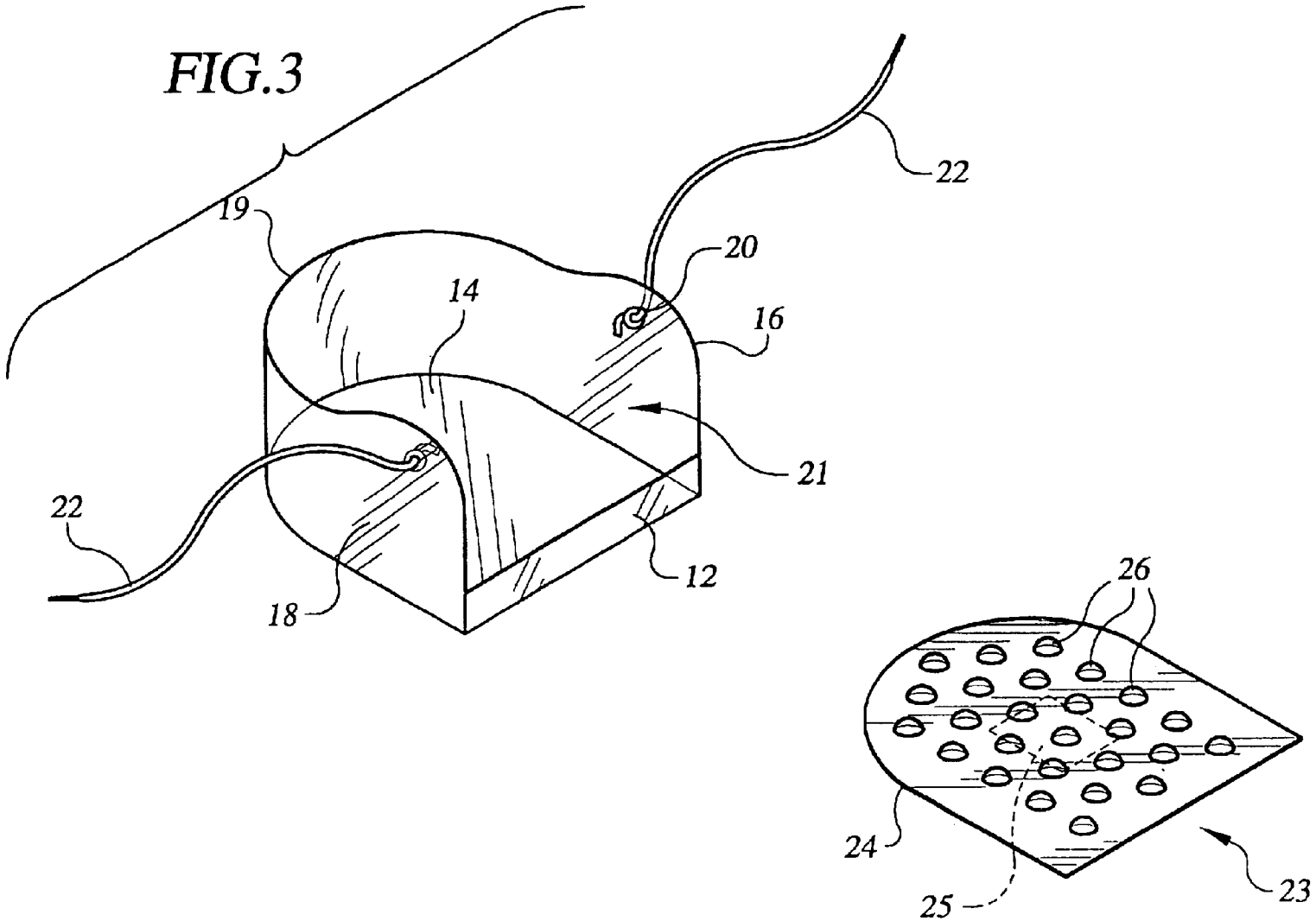
FIG. 3 is an exploded, side elevation view of one version of the removable heel cushion of the invention, illustrating the heel pocket portion of the invention equipped with a pair of shoe lace fasteners, and a formed hemisphere filled polyurethane sheet shock absorber portion.
Figure 4:
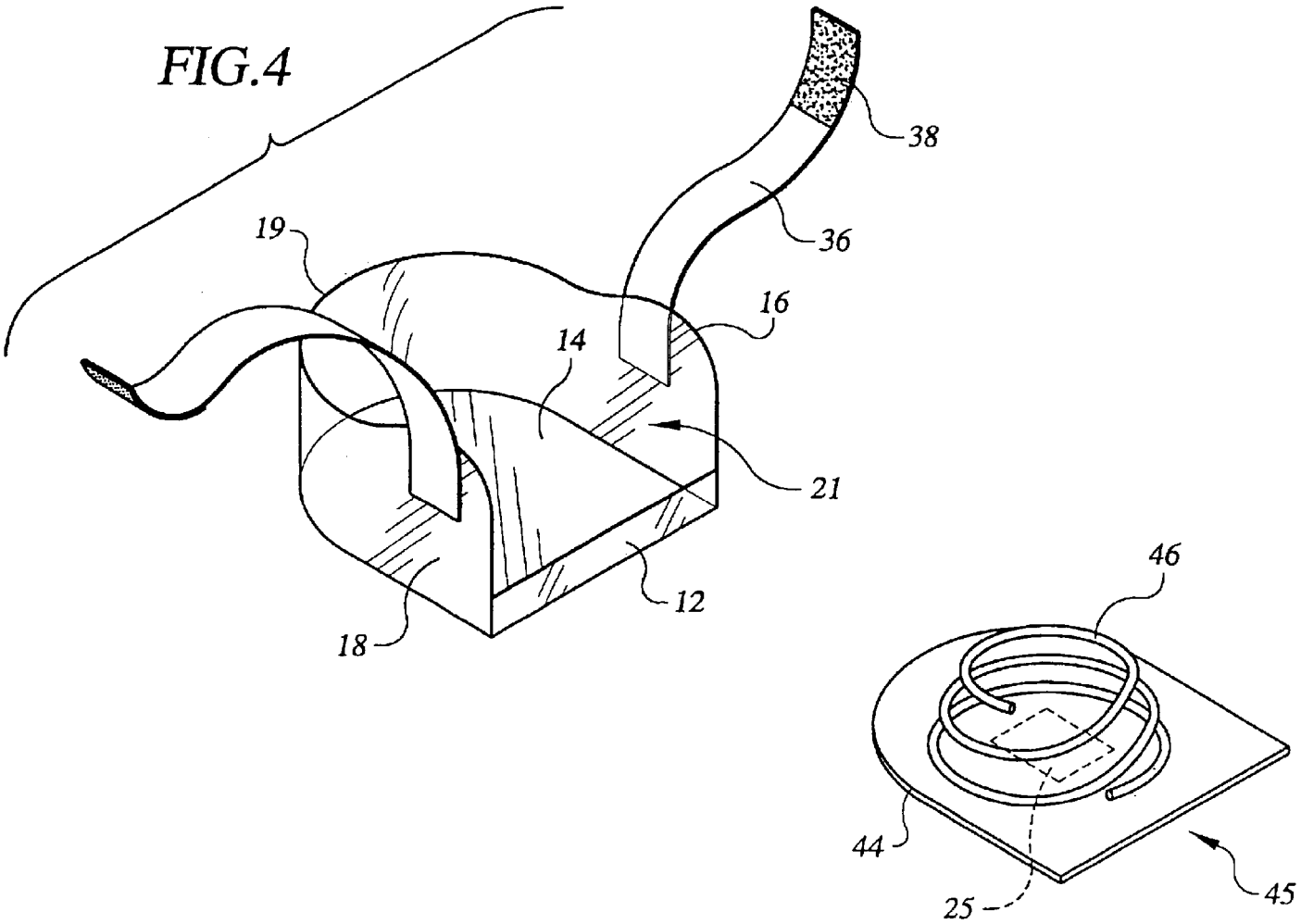
FIG. 4 is an exploded, side elevation view of one version of the removable heel cushion of the invention, illustrating the heel pocket portion of the invention equipped with a pair of hook and loop fasteners, and a coiled spring shock absorber portion.

Preferred structures for the invention are best seen in FIGS. 3 and 4. While the removable heel cushion 10 of the invention can be fabricated in many convenient ways, such as out of leather, cloth, or a variety of plastics, clear polyurethane plastic has been found particularly suitable due to its toughness and economy in fabrication. In FIG. 3 the cushion 10 is shown comprised of a clear polyurethane heel pocket 21 formed by a floor 14, upstanding left 16 and right 18 sides confluent with an arcuate upstanding rear wall 19, and a front panel 12 for securing a resilient shock absorber when it is placed within the heel pocket 21. Dimensions for the heel pocket 21 can be, for example, 3½" wide×4" long, with rear wall and sides measuring 2" in height. The front panel extends between the sides, measuring approximately ⅜" in height. One convenient means for securing the cushion 10 to the shoe can be a pair of shoe laces 22, each one secured near the top edge of a side by means of a hole 20 punched in each side. The shoe lace 22 is then simply threaded through the hole 20, and knotted at one side of the hole so as to be secured to the top edge of the side. FIG. 3 also illustrates a preferred configuration for a shock absorber to be placed within the heel pocket 21. A formed polyurethane sheet shock absorber 23 is shown. The polyurethane sheet 24 is converted into an efficient shock absorber by vacuum forming a series of hemispheres 26 into the sheet. The polyurethane sheet 24 can be 0.020" in thickness, and measure approximately 3¼" in width and 3¾" in length. A series of hemispheres, measuring approximately ⅜" in width×¼" in height can be vacuum formed in the sheet 24. A means for positionally securing the formed polyurethane sheet shock absorber 23 within the heel pocket 21 can be a tongue and groove mechanism (not shown), or, for example, a frangible adhesive patch 25. The frangible adhesive patch 25, shown in phantom in FIG. 3, can be affixed to the underside opposite the raised hemispheres, of a portion of the polyurethane sheet 24 so as to provide a supplied "spot-glued" attachment to the floor 14 of the heel pocket. The frangible adhesive patch can have a peel away cover (not shown) for user convenience for versions of the removable heel cushion wherein the customer affixes a selected shock absorber within the heel pocket of the removable heel cushion. In this case of customer placement, the formed polyurethane sheet shock absorber 23 is simply placed within and positively secured to the heel pocket, thereby forming an efficient and economical resilient shock absorber. Obviously this shock absorber can be increased or decreased in shock absorbing characteristics by changing the above noted dimensions so as to obtain a series of shock absorbing characteristics. For example, a second formed polyurethane shock absorber 23 can be secured on top of the first one. Or a third and fourth formed polyurethane shock absorber can be secured, one on top of another, enabling a user to custom adjust shock absorption. And, of course, depressions other than hemispheres can be vacuum formed in the sheet, and a variety of other plastics and/or rubber can be employed according to designer preferences.

Figure 6:
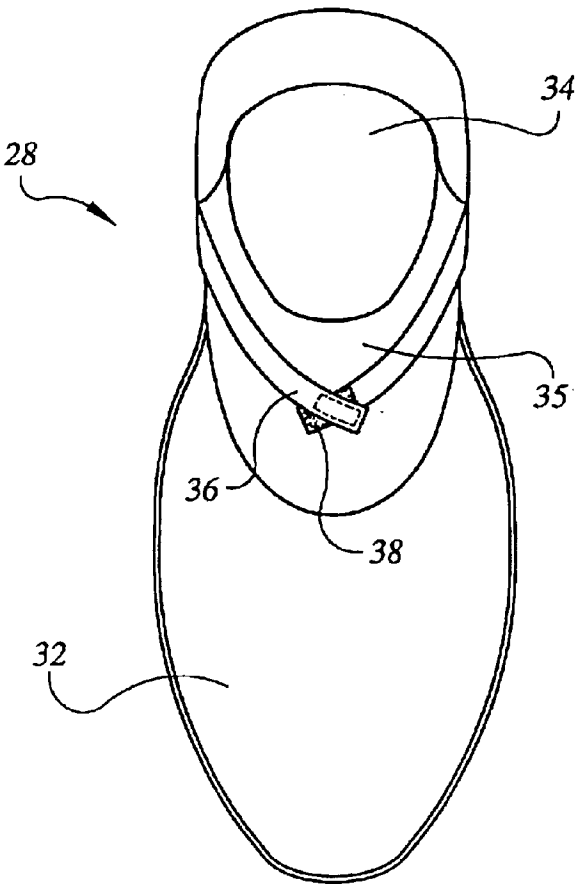
FIG. 6 is a top plan view of one version of the removable heel cushion of the invention, illustrating a pair of hook and loop fasteners securing the invention to a shoe and the top portion adjacent an ankle of a users foot secured within the shoe.

FIG. 4 is a view similar to FIG. 3 described above, illustrating a second preferred embodiment for a fast, convenient quick attach-quick release mechanism for the removable heel cushion 10 of the invention. In this case a pair of plastic strips 36 are heat sealed at one end to the top edges of the sides 16, 18 of the heel pocket 21. At the other end of each of the straps 36 a section of hook and loop fasteners 38 is affixed to opposed surfaces of the straps. As best seen in FIGS. 1 and 6 this fastening method now provides a quick and easy connect-disconnect mechanism for securing the assembled cushion 10 to a shoe 28. The straps can be fabricated in polyurethane and other plastics, or other materials such as leather of cloth, and can be affixed to the heel pocket 21 in any convenient manner, including gluing and sewing. Also shown in FIG. 4 is an example of another type of resilient shock absorber 45, in this case comprising a coiled spring 46 affixed to a base plate 44, with the bottom of the base plate having, for example, an attached frangible adhesive patch 25, shown in phantom in FIG. 4, for positionally securing the shock absorber within the heel cushion 21. The coiled spring can be made of metal, rubber, or plastic, and can, of course, be made available in a number of different shock absorbing capacities according to user preference. Again, simply placing and positionally securing the shock absorber 45 in the heel pocket 21 completes the supplied assemblage of the cushion 10 for efficient, customer oriented heel resilient shock absorption. It is to be noted that the discussion of a polyurethane shock absorber 23 and coiled spring shock absorber 45 are for illustrative purposes. Obviously a variety of other shock absorbers, including packets of water or air, and so on, can be employed without departing from the disclosure of the invention. And, of course, a variety of other frangible attachments of the shock absorber to the heel pocket can be employed, including tongue and groove structures (not shown), and hook and loop fasteners such as VELCRO™ (not shown).

Figure 5:
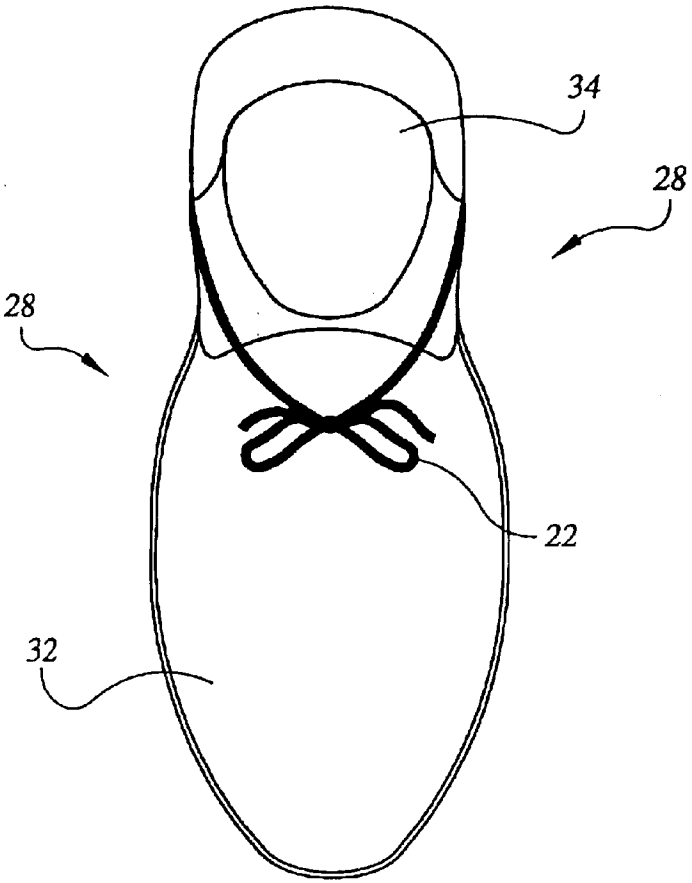
FIG. 5 is a top plan view of one version of the removable heel cushion of the invention, illustrating a pair of shoe laces securing the removable heel cushion to a shoe.

FIGS. 5 and 6 illustrate an important aspect of the invention. In FIG. 5 a pair of shoe laces are shown as being tied together over the top portion 32 of a shoe 28, securing the removable heel cushion 10 to the shoe. And in FIG. 6 a pair of straps 36, the ends of which have opposing hook and loop fasteners 38 attached, are shown as being fastened together over the upper portion of a shoe 28 and the top portion 35 of a foot of a person wearing the shoe 28, securing the removable heel cushion to the shoe. Its just a matter of seconds to connect the cushions to virtually any shoe, and equally important, just a matter of seconds to remove the cushions. Users are thereby provided with a unique, new convenience in foot comfort. Whenever the need arises, the removable heel cushion of the invention can be available for immediate relief. When no longer required it is quickly removed and stored. Obviously a variety of other quick connect-disconnect mechanisms can be similarly employed without departing from the disclosure of the invention.

While the present invention has been disclosed in connection with versions shown in detail, various modifications and improvements will become readily apparent to those skilled in the art. Accordingly, the spirit and scope of the present invention is to be limited only by the following claims.

What is claimed is:

1. A removable heel cushion, comprising:

(a) a heel pocket, said heel pocket being configured to accommodate a heel portion of a shoe selected from the group consisting of said shoe having a substantially flat sole, and said shoe having a typical rear heel extending downward from said sole, said heel pocket having a solid floor confluently bordered with an upstanding arcuate rear wall, an upstanding left side wall, an upstanding right side wall, and an upstanding front retaining wall, said upstanding front retaining wall being substantially narrow in width in comparison with said upstanding left and right side walls and arcuate rear wall;

(b) a resilient shock absorber configured for placement within said heel pocket, said resilient shock absorber being positionally secured within said heel pocket; and (c) means for quick connection and disconnection of said heel pocket to said heel portion of said shoe, so that activating said means for quick connection and disconnection of said heel pocket provides users with a cushioned gait at said heel portion of said shoe at any time considered desirable by said user.

2. The removable heel cushion according to claim 1, further comprising frangible means for positionally securing said resilient shock absorber within said heel pocket.

3. The removable heel cushion according to claim 1 wherein said frangible means for positionaly securing said resilient shock absorber to said heel pocket is an adhesive patch affixed to a base portion of said resilient shock absorber.

4. The removable heel cushion according to claim 1 wherein said means for quick connection and disconnection of said heel pocket to said shoe comprises a pair of shoe laces, one end of a first one of said pair of shoe laces being affixed to said left upstanding side wall, and one end of a second one of said pair of shoe laces being affixed to said right side upstanding side wall.

5. The removable heel cushion according to claim 1 wherein said means for quick connection and disconnection of said heel pocket to said shoe comprises a pair of straps, each one of said pair of straps having a first end and a second end, said first end of each strap being affixed opposite one another with one of said straps being affixed to said left upstanding side wall and the other of said straps being affixed to said right side upstanding side wall, said second end of each one of said straps having a section of hook and loop fastener attached, said hook and loop fastener attachments being positioned on said second end of each one of said straps in a facing relationship to each other.

6. The removable heel cushion according to claim 1 wherein said resilient shock absorber comprises a coiled spring, said coiled spring being fabricated in a material selected from the group consisting of rubber, plastic, or metal.

7. The removable heel cushion according to claim 1 wherein said resilient shock absorber is comprised of a sheet of resilient plastic, said sheet of plastic having a series of uniform depressions formed within, so that when said removable heel cushion is in use said gait of said user causes said depressions to be compressed and then returned to their original shape during continuation of said gait, said resilient action of said depressions thereby cushioning said gait of said user at said heel portion of said shoe.

8. The removable heel cushion according to claim 7 wherein said depressions are a uniform series of hemispheres formed in said sheet of plastic.

9. The removable heel cushion according to claim 8, further comprising at least two of said resilient shock absorbers being placed within and positionally secured within said heel pocket.

10. The removable heel cushion according to claim 7, further comprising at least two of said resilient shock absorbers being placed within and positionally secured within said heel pocket.

11. The removable heel cushion according to claim 7 wherein said sheet of resilient plastic is a sheet of polyurethane plastic.

12. The removable heel cushion according to claim 1 wherein said heel pocket is fabricated in polyurethane plastic.

13. A method for cushioning a heel portion of a shoe during normal walking, comprising the steps of:

(a) creating a heel pocket, said heel pocket being configured to accommodate a heel portion of said shoe selected from the group consisting of said shoe having a substantially flat sole, and said shoe having a typical rear heel extending downward from said sole, said heel pocket having a solid floor confluently bordered with an upstanding arcuate rear wall, an upstanding left side wall, an upstanding right side wail, and an upstanding front retaining wall, said upstanding front retaining wall being substantially narrow in width in comparison with said upstanding left and right side walls and said arcuate rear wall;

(b) positionally securing a resilient shock absorber within said heel pocket;

(c) placing said heel portion of said wide variety of everyday shoe within said heel pocket;

(d) securing said heel pocket to said shoe utilizing quick-secure, quick-release attachment components of said heel pocket, thereby providing a user with a cushioned gait; and (e) removing said heel pocket from said shoe at said user's convenience when not required utilizing said quick-secure, quick-release components of said heel pocket.

14. The method according to claim 13 wherein said resilient shock absorber is a coiled spring.

15. The method according to claim 13 wherein said resilient shock absorber is a sheet of resilient plastic having a series of uniform depressions formed therein.

16. The method according to claim 13 wherein said quick-secure, quick-release attachments are a pair of shoe laces, one of said pair of shoe laces being affixed to a left side of said heel pocket, and the other of said pair of shoe laces being affixed to a right side of said heel pocket.

17. The method according to claim 13 wherein said quick-secure, quick-release attachments are a pair of straps, each one of said pair of straps being affixed, at one end of each strap, opposite one another to a left and a right side of said heel pocket, a free end of each strap having a section of hoop and loop fastener attached opposite one another for said quick-secure, quick-release attachment as required.

18. The method according to claim 13, further comprising the steps of placing and positionally securing at least two of said resilient shock absorbers within said heel pocket.

19. The method according to claim 13 wherein said resilient shock absorber is positionally secured to said heel pocket of said removable heel cushion utilizing a frangible mechanism.

20. The method according to claim 19 wherein said frangible mechanism is an adhesive patch affixed to a base portion of said resilient shock absorber.

* * * * *